United States Patent [19]

Albright

[11] 4,038,751

[45] Aug. 2, 1977

[54] MAT CUTTING DEVICE

[76] Inventor: Alto O. Albright, 818 - 16th Ave. West, Kirkland, Wash. 98033

[21] Appl. No.: 627,967

[22] Filed: Nov. 3, 1975

Related U.S. Application Data

[63] Continuation of Ser. No. 506,230, Sept. 16, 1974, abandoned, which is a continuation-in-part of Ser. No. 466,534, May 3, 1974, abandoned.

[51] Int. Cl.[2] ..... B26B 3/08; B26D 5/00

[52] U.S. Cl. ..... 30/293; 33/76 R; 83/614

[58] Field of Search ..... 30/293, 294; 83/613, 83/614, 455; 33/76 R, 32 R, 32 G

[56] References Cited

U.S. PATENT DOCUMENTS

| | | | |
|---|---|---|---|
| 1,115,333 | 10/1914 | Pease | 33/76 |
| 1,569,090 | 1/1926 | Johnson | 33/76 |
| 2,160,186 | 5/1939 | Williams | 33/76 |
| 2,835,037 | 5/1958 | Middents | 33/76 |
| 2,924,010 | 2/1960 | Umholtz | 30/293 |
| 3,003,243 | 10/1961 | Kanzelberger | 33/76 |

*Primary Examiner*—Jimmy C. Peters
*Attorney, Agent, or Firm*—Dowrey & Cross

[57] ABSTRACT

The mat cutting apparatus includes a cutter for making a bevel cut and an adjustable edge guide having a vertical straight edge surface with which a vertical flat surface on the cutter is slidably engaged as the cutter is pushed along the edge guide to make a straight, beveled cut parallel to one edge of the mat. When used to cut an opening in a mat for mounting pictures or the like, the outline of the picture is traced on the back of the mat parallel to the edges thereof and then the mat is secured face down on the edge guide with the straight edge surface positioned adjacent and parallel to one traced line. The cut is made from the back surface of the mat such that the cut through the front mat surface registers with the traced line on the back mat surface. The mat is turned, the edge guide repositoined and the cutting process repeated until the mat opening is cut out completely. No measurements need be made when using this cutting procedure; however the edge guide also includes indicia by which the border about the mat opening can be sized.

4 Claims, 4 Drawing Figures

FIG. 1
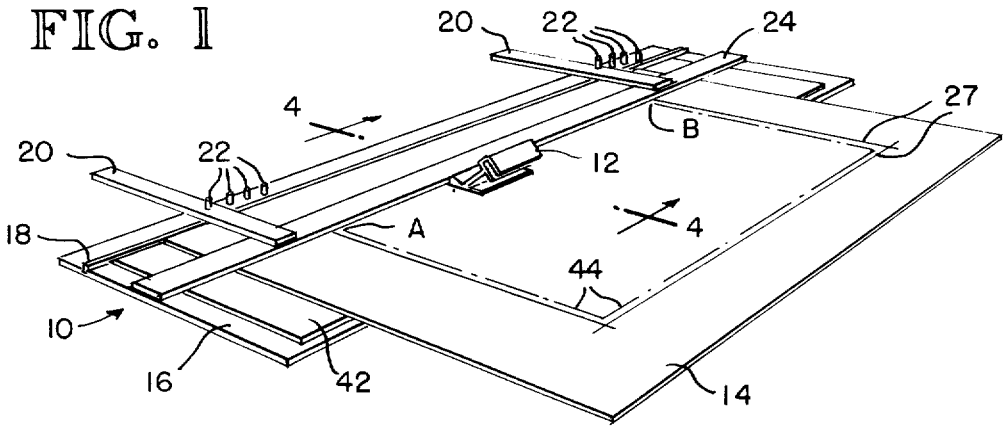
FIG. 2
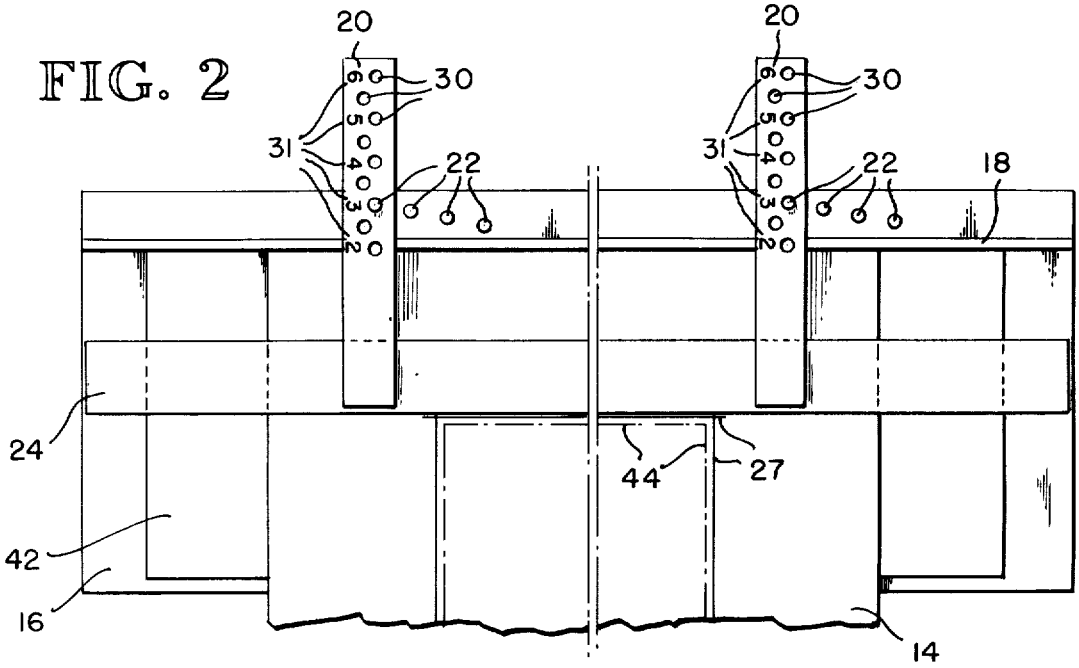
FIG. 3
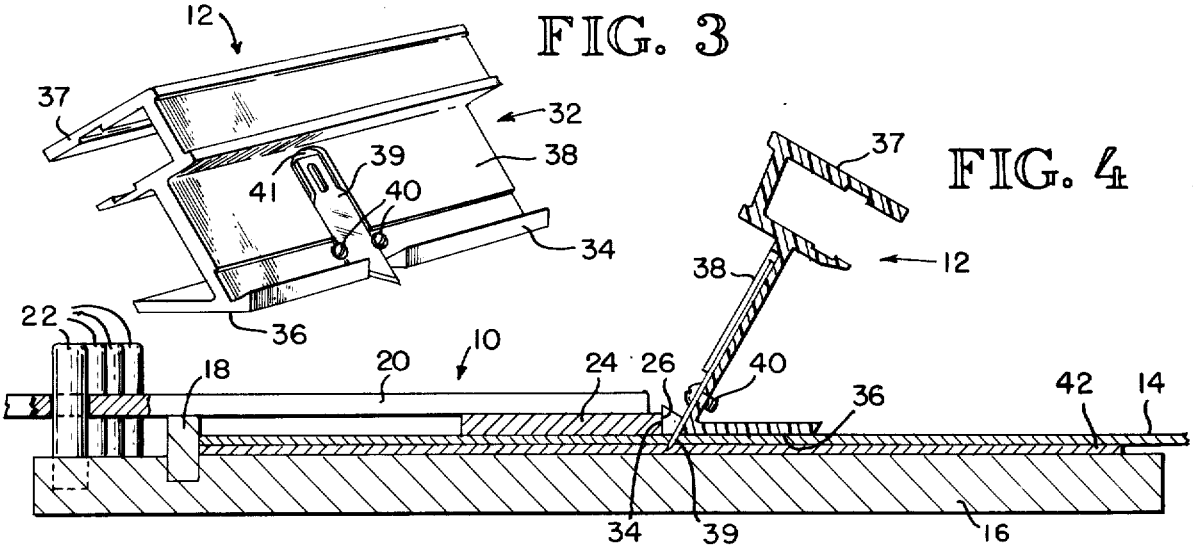
FIG. 4

MAT CUTTING DEVICE

This application is a continuation of my application, Ser. No. 506,230 abandoned, filed Sept. 16, 1974 entitled MAT CUTTING DEVICE, a continuation-in-part of my prior application Ser. No. 466,534, abandoned, filed May 3, 1974, entitled MAT CUTTING DEVICE.

BACKGROUND OF THE INVENTION

This invention relates to apparatus for cutting flat articles and, more particularly, for cutting mats used in mounting flat objects such as pictures, photographs, paintings and the like. In some applications, the mid section of the mat is cut out to form an opening having an outline corresponding to but slightly smaller than the periphery of the object to be mounted; in other applications in which the picture is cropped, the opening has an outline substantially smaller than the periphery of the picture. The edges of this opening desirably are beveled and parallel to the edges of the mat.

The fabrication of such mats heretofore has been difficult and time consuming, involving measuring the object, transferring these measurements to the front surface of the uncut mat and then cutting the mat with knives or razor blades held against T,squares, rules, etc. to provide a straight line cut. This measurement procedure is prone to error and leaves unsightly marks or lines on the face of the mat. Furthermore, at the hands of an inexperienced or "do it yourself" person, the finished mat is often of poor quality. The mat opening typically is cut unevenly because it is difficult to draw the cutting instrument along a straight edge while maintaining a constant bevel angle. Automated cutting apparatus including one or more movable cutters have been devised; however, such apparatus are expensive, complex, and require skill and training to operate.

SUMMARY OF THE INVENTION

This invention provides simple, highly effective mat cutting apparatus suitable for use by inexperienced or professional persons. The cutting apparatus of this invention, of course, if useful to cut beveled openings in many flat articles; however, it is particularly suitable for cutting beveled openings in flat, rectilinearly outlined articles, for example, picture mats, such that adjacent edges of the article and opening are mutually parallel.

The outline of the object to be mounted is first traced upon the back surface of the mat. To cut out the mat opening, the mat is held face down and a cutter positioned by an adjustable straight edge cutting guide is pushed along the traced object outline so as to cut the mat from its back to front surfaces. The cutter provides an even bevel cut which terminates at the front surface of the mat along a line substantially registering with the traced outline of the object. The cutting guide is adjustable incrementally without the need to measure the actual dimensions of the object, the opening, or the article and also serves to securely hold the mat during the cutting process. The cutting guide may include indicia by which the border about the opening is sized.

These and other objects, features and advantages of this invention will become apparent in the detailed description and claims to follow, taken in conjunction with the accompanying drawings wherein like parts bear like reference numerals.

BRIEF DESCRIPTION OF THE DRAWINGS

FIG. 1 is a perspective of the mat cutting apparatus of this invention with a mat in position for cutting;

FIG. 2 is a top view on expanded scale and in more detail of the cutting guide of FIG. 1;

FIG. 3 is a perspective of the cutter of FIG. 1;

FIG. 4 is a cross section taken along lines 4—4 in FIG. 1.

DETAILED DESCRIPTION OF THE PREFERRED EMBODIMENT

According to the example of FIG. 1, the mat cutting apparatus of this invention comprises an adjustable straight edge guide 10 and a cutter 12. A generally square or rectangular mat 14 is held securely front side or face down by the edge guide 10. When used with the illustrated mat, the mat cutting apparatus is suitable for cutting out a square or rectangular opening having edges which are beveled and respectively parallel to the four edges of the mat. However, the cutting apparatus may be used to provide an opening having beveled rectilinear edges substantially parallel to the rectilinear edges of mats having other or nonquadrilateral outlines. For example, it may be used to cut triangular openings in triangular mats, hexagonal openings in hexagonal mats, etc.

The edge guide 10 is made up of a flat platform 16 against which the front side of the mat is held face down and a rectilinear shoulder 18 upstanding from the side of the edge guide platform 16. The edge of the mat adjacent and parallel to the cut to be made abuts against and is positioned by this shoulder. A pair of positioning arms 20 are respectively engaged at one end with one of a series of pegs 22 upstanding from the edge guide platform 16 to one side of the edge guide shoulder 18. The positioning arms 20 rest against the upper edge of this shoulder and project from the other side thereof over the mat. An elongated guide plate 24 terminating in a vertical flat cutting edge 26 (FIG. 4) is secured to the other ends of the positioning arms 20 which when engaged with cprresponding pegs 22 position the guide plate cutting edge parallel to the edge guide shoulder 18. The guide plate rests against the back surface of the mat and positively holds the mat flat against the edge guide platform 16 with its outer edge against the edge guide shoulder 18. In this position, the guide plate cutting edge 26 is adjacent and parallel to the side of the opening along which the cut is to be made. Suitable weights, of course, may be attached to the guide plate or positioning arms to provide more positive retention of the mat.

The lateral separation between the guide plate cutting edge 26 and the edge guide shoulder 18 may be varied incrementally to correspond to the desired border about the mat opening, the outline of which is first traced by the user from the periphery of the rectangular object to be mounted upon the upwardly facing back surface of the mat, as depicted in lines 27 in FIGS. 1 and 2. As best shown in FIG. 3, the positioning arms 20 each include a series of holes 30 with which the pegs 22 are engaged. These pegs extend in lines which are relatively inclined to the edge guide shoulder 18. By selectively engaging one of the positioning arm holes 30 with the pegs 22, the separation of the guide plate cutting edge 26 and edge guide shoulder 18 is varied in large and small increments corresponding, respectively, to the center-to-center lateral separation between adjacent positioning arm holes 30 and edge guide pegs 22. For example, by laterally spacing the positioning arm holes at ½ inch intervals, and the edge guide pegs at ⅛ intervals, it is possible to adjust the guide plate cutting edge 26 to within ⅛ inch of the traced line 27 along which a cut is to be made. The guide plate 24 is positioned by first placing its vertical cutting edge 26 adjacent this traced line, and then interengaging the nearest corresponding positioning arm holes and pegs. However, to size a border about the mat opening, indicia 31 in the form of numbers are provided on the arms adjacent alternate arm holes 30 such that engaging a designated hole with a peg 22 will cause the guide plate cutting edge 26 to be positioned a predetermined distance from the edge guide shoulder 18. For example, the guide plate cutting edge is depicted in FIG. 2 in position to provide a border 3 inches in width. Thus, it will be appreciated that the user need not measure the actual distance between the outer edge of the mat 14 and the traced outline 27 of the object being mounted, or the width of the border about the mat opening. The increments by which the guide plate is adjusted to match the traced line, of course, may be varied; however, for most applications, ⅛ inch increments are sufficient.

Still referring to FIG. 2, alternate positioning arm holes 30 are staggered or offset transversely to the length of the positioning arms 20. The hole arrangement eliminates or minimizes tendency of the user to inadvertently inter-engage noncorresponding positioning arm holes 30 and edge guide pegs 22 and hence ensures parallelism between the edge guide shoulder and guide plate.

As best shown in FIGS. 3 and 4, the cutter of this invention comprises a plate-like generally L-shaped body 32 having flat, mutually perpendicular front and bottom surfaces 34 and 36, a generally U-shaped handle 37, and an intermediate inclined surface 38. The cutter is formed as a monolithic member, preferably of molded plastic. A cutting blade 39 gripped positively between mutually opposed screws 40 is secured flat within a recess 41 formed in the inclined body surface 38 so as to project downwardly from the bottom body surface 36, as shown (FIG. 4). By loosening screws 40, the cutting blade 39 can be moved up or down to vary the distance by which it projects from the bottom body surface 36 and hence vary the depth of cut. The body front and inclined surfaces 34 and 38 are spaced from each other such that the blade is laterally offset from the front body surface 34.

To cut out the mat opening, the cutter is placed on the straight edge guide 10 with its front body surface 34 in face-to-face sliding engagement with the guide plate cutting edge 26, as shown (FIG. 4) and its cutting blade 39 engaged with the mat 14 just inside the traced corner A (FIG. 1) of the mat opening. As best shown in FIG. 4, the cutting blade projects through the front surface of the mat and engages a removable platform cover 42 which can be replaced, as desired. This cover shields and protects the platform from being cut and ensures that the cutting blade cuts completely through the mat for a clean edge. The cutter is pushed along the straight line until reaching a location just inside the opposite traced corner B (FIG. 1) of the mat opening. The mat is then turned and the cutting process repeated along the remaining three edges of the opening. The cut-out portion of the mat then drops out or can be removed with little difficulty.

As the cutter is pushed along the straight edge guide in this manner, the inclined orientation of the cutting blade 39 relative to the front and back surfaces of the mat 14 provides a beveled cut. This inclined orientation also lends stability to the cutter as it is pushed along the cut to provide a smooth, even cut. The cutter also compensates automatically for the cutting blade bevel angle so that the cut line through the opposite downwardly facing front may surface substantially registers with traced line 27 on the back mat surface. This compensation is provided by the above-described lateral offset of the cutting blade 39. That is, the cutting blade makes cuts 44 (FIG. 1 and 2) along the back mat surface. As most clearly shown in FIG. 2, these cuts are spaced inwardly from the traced lines 27 on the back mat surface; however, because of the inclination of the cutting blade, the cuts through the mat front surface are spaced outwardly from the back mat surface cuts 44 and hence substantially register with the traced line 27. It will be recognized that the position of the cut line through the mat front surface may vary depending upon the thickness of the mat, or the bevel angle of the cutter. The cutter, of course, may be provided with a cutting blade which is fixed or adjusted to a perpendicular orientation relative to the body bottom surface if a square or right angle cut is desired. The cutter may be used, of course, to make cuts along the edges of the mat.

In most practical cases in which a painting or the like is matted, the cut is made to cover the painting at least ¼ to ⅜ inches from the edge. With this device, any cropping is done easily by locating the portion of the painting not covered by the mat equal distance from the outer edges of the mat already cut to size. Then the line positions are marked on the back of the mat and the mat is placed on the edge guide 10 as described above. These steps are done without actually measuring the mat or painting. However, if a border of predetermined or known width is desired, or the picture is to be double or triple matted with two or more superimposed mats having openings of different sizes, the border width is selected and the appropriate hole designated by the numbered indicia 31 engaged with the corresponding peg 22 so as to position the guide plate at the desired distance from the edge of the mat. The numbered indicia 31 also serve as indicators for checking the position of the guide plate. Preferably, the cutter makes a cut which is spaced laterally ⅛ inch from the guide plate cutting edge 26. This spacing is included in the distances represented by the numbered indicia 31. For example, to provide a 3 inch border as described above, the guide plate cutting edge is positioned by the holes 30 at a distance of 2⅞ inches from the edge guide shoulder 18.

The mat cutting apparatus of this invention is simple enough to be used effectively by an inexperienced or "do it yourself" person; however, this invention may be used in an automated or high speed system in which a large number of mats are cut sequentially. To this end, suitable counterweights (not shown) may be attached to ends of the positioning arms to cause them to swing vertically about the edge guide shoulder 18. Stops (also not shown) may be attached to the guide plate 24 or to the platform 16 adjacent the ends A, B of the cutting path between the corners of the mat opening so as to engage and stop movement of the cutter at the beginning and end of each cut. As will be appreciated, the mat cutting apparatus of this invention may be used to cut mats larger than that illustrated because each cut is made relative to the edge of the mat nearest the cut being made without the use of extensible cutter supporting arms and guides as would be necessary, for example, if the mat was not rotated after each cut.

While the preferred embodiment of this invention has been illustrated and described herein, it should be understood that variations will become apparent to one skilled in the art. Accordingly, the invention is not to be limited to the specific embodiment illustrated.

I claim:

1. Apparatus for cutting a flat article having a rectilinear edge comprising:

cutter means for making a cut in the article;

platform means for supporting the article, said platform means including rectilinear shoulder means upstanding therefrom for engaging and positioning the rectilinear edge of the article;

cutter guide means for guiding said cutter means along a rectilinear path; and cutter guide positioning means extending in overlying relation with the article from the rectilinear edge thereof for selectively positioning said cutter guide means to guide said cutter means along a rectilinear path spaced from and substantially parallel to the rectilinear edge, when the article is supported and positioned by said platform means; said cutter guide positioning means including connecting means for adjustably connecting said cutter guide means with said platform means adjacent said shoulder means, to vary the distance between said rectilinear path and the rectilinear edge of the article in preselected increments, said connecting means comprising means forming a plurality of positioning holes and peg means upstanding from said platform means adjacent said shoulder means for engaging selected ones of said holes.

2. The apparatus of claim 1, wherein the holes are arranged in two series, each including holes alternately displaced on each side of a line extending perpendicular to said shoulder means in order to lessen the possibility of improperly positioning said cutter guide means.

3. The apparatus of claim 1, wherein said connecting means includes two spaced apart parallel arms, each including at least one positioning hole.

4. Apparatus for cutting a flat article having a rectilinear edge comprising:

cutter means for making a cut in the article;

platform means for supporting the article, said platform means including rectilinear shoulder means upstanding therefrom for engaging and positioning the rectilinear edge of the article;

cutter guide means for guiding said cutter means along a rectilinear path; and cutter guide positioning means extending in overlying relation with the article from the rectilinear edge thereof for selectively positioning said cutter guide means to guide said cutter means along a rectilinear path spaced from and substantially parallel to the rectilinear edge, when the article is supported and positioned by said platform means, said cutter guide positioning means including connecting means for adjustably connecting said cutter guide means with said platform means at a plurality of spaced locations along the length thereof adjacent said shoulder means to selectively vary the distance between said rectilinear path and the rectilinear edge of the article while insuring parallelsim therebetween, said connecting means comprising means forming a plurality of positioning holes and peg means at each of said spaced locations, said peg means upstanding from said platform means adjacent said shoulder means for engaging selected ones of said holes.

* * * * *